United States Patent [19]

Gagliardo

[11] 3,989,109

[45] Nov. 2, 1976

[54] FIRE FIGHTING TURRET

[75] Inventor: John P. Gagliardo, Shrewsbury, Mass.

[73] Assignee: Feecon Corporation, Westboro, Mass.

[22] Filed: July 21, 1975

[21] Appl. No.: 597,570

[52] U.S. Cl. ..... 169/24; 169/25; 239/587; 285/181

[51] Int. Cl.[2] ..... A62C 27/16; B05B 15/06

[58] Field of Search ..... 239/587; 169/24, 25; 285/181; 137/615; 141/387

[56] References Cited

UNITED STATES PATENTS

| | | | |
|---|---|---|---|
| 2,587,938 | 3/1952 | Warren | 239/587 X |
| 2,927,607 | 3/1960 | Bily | 137/615 |
| 2,986,344 | 5/1961 | Knight | 239/587 |
| 3,840,074 | 10/1974 | Clark | 239/587 X |

*Primary Examiner*—John J. Love
*Assistant Examiner*—Andres Kashinikow
*Attorney, Agent, or Firm*—Norman S. Blodgett; Gerry A. Blodgett

[57] ABSTRACT

A fire fighting turret including three 90° elbows arranged seriatim with swivel joints where the two end elbows are connected to the central elbow attached to a second turret in such a manner that reaction forces create no problem and the field of aiming is affected very little.

8 Claims, 6 Drawing Figures

FIRE FIGHTING TURRET

BACKGROUND OF THE INVENTION

In the design and manufacture of fire fighting equipment it is common practice to mount a turret on the roof of the cab of a fire truck. This turret receives the fire extenguishing medium and passes it to a nozzle at its output end. The nozzle is usually mounted on the turret for swinging about a vertical axis and also for swinging about a horizontal axis. In many cases it is desirable to provide two nozzles each one carrying a different fire fighting medium. It is the usual practice to provide for this second nozzle to swing in horizontal and vertical planes at the same time that the first nozzle is moved. However, since the passages through the turret have already been connected to the first nozzle for the passage of the first fire fighting medium, it is difficult to transmit a second fire fighting medium to the second nozzle. A flexible hose or conduit would allow the necessary universal movement of the second nozzle, but could not possibly be constructed in such a way as to resist the pressure of the medium as well as the swiveling conditions to which the equipment is subjected. Attempts to make the connection of the second medium to the second nozzle by use of conventional piping have resulted in an expensive construction and have also resulted in large force couples on the equipment due to nozzle reaction. These force couples must be resisted by the operator within the cab, making it difficult for him to aim the nozzle properly. These and other difficulties experienced with the prior art devices have been obviated in a novel manner by the present invention.

It is, therefore, an outstanding object of the invention to provide a fire fighting turret including a simple means for carrying a second fire extinguishing medium to a second nozzle.

Another object of this invention is the provision of a dual agent fire fighting turret including an extinguishing medium supply means that permits universal motion of the two nozzles without large force couples on the pivotal axis.

A further object of the present invention is the provision of a fire fighting turret including a second conduit connection, which is simple in construction, inexpensive to manufacture, and which is capable of a long life of useful service with a minimum of maintenance.

It is another object of the instant invention to provide a fire fighting turret providing for the mounting of two nozzles for carrying two different fire extinquishing media, wherein both nozzles are capable of swinging in a horizontal plane as well as vertical planes, and in which no appreciable force couple due to nozzle reaction is experienced.

A still further object of the invention is the provision of a fire fighting turret including a means of connecting a universally movable nozzle to a fixed source of fire extinguishing medium, which connection involves a small number of parts and interconnections for the parts.

With these and other objects in view, as will be apparent to those skilled in the art, the invention resides in the combination of parts set forth in the specification and covered by the claims appended hereto.

SUMMARY OF THE INVENTION

In general, the invention consists of a fire fighting turret having apparatus for joining for the flow of fire extinguishing medium from a fixed inlet pipe to a universally-adjustable gun barrel having a nozzle at one end. The apparatus includes a first 90° elbow having one leg fixedly attached to the said pipe, a second 90° elbow having one leg attached by a swivel joint to the other leg of the first elbow, and a third 90° elbow having one leg attached by a swivel joint to the other leg of the second elbow. More specifically, a fitting is provided having one end fixedly attached to the other leg of the third elbow and having its other end fixedly attached to the inlet end of the gun barrel. The center line of the barrel lies in a plane passing through the axis of the first-mentioned swivel joint.

More specifically, the axis of rotation of the second swivel joint is horizontal to allow the barrel to swing in a vertical plane and the axis of the first swivel joint is vertical to allow the barrel to swing about the vertical axis. The vertical plane of swing of the barrel passes through the vertical axis of rotation, so that the nozzle reaction force produces a zero force couple about the third vertical axis.

This apparatus is attached to the rotating body of the first turret with both vertical axes parallel and in line with each other. The horizontal axis of both turrets are parallel to each other.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
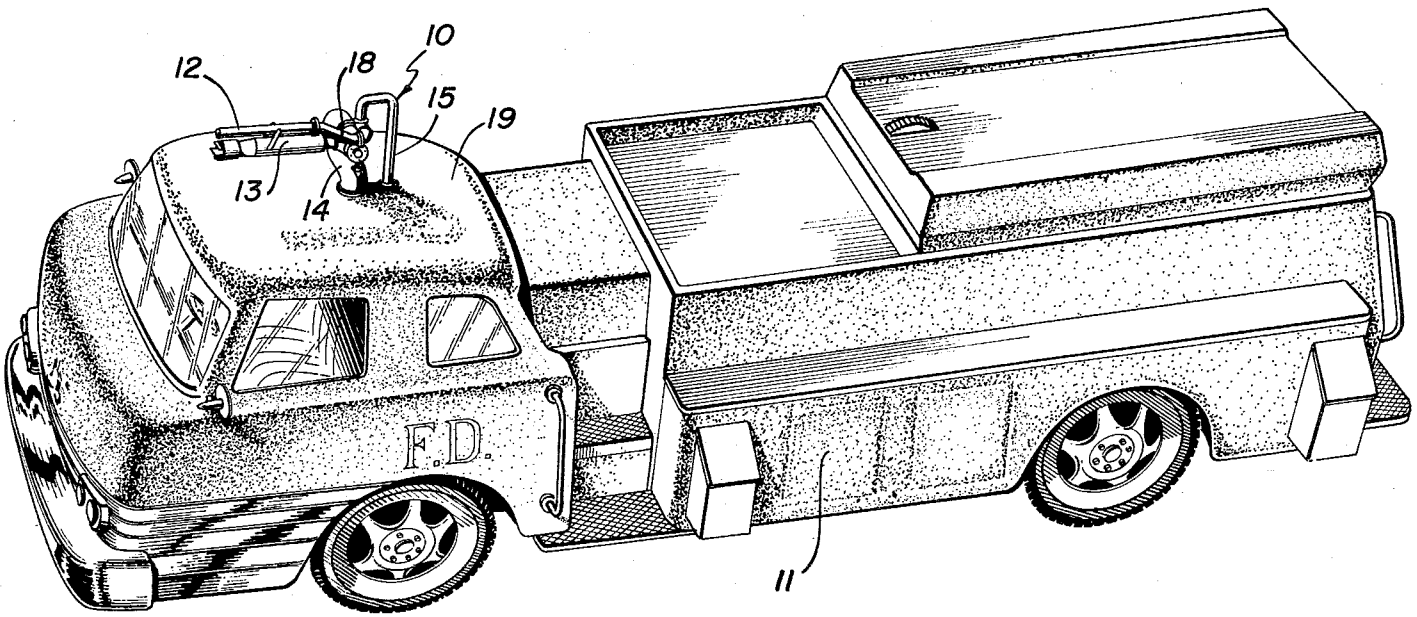
FIG. 1 is a perspective view of a fire fighting turret embodying the principles of the present invention, shown mounted on a fire truck.

Referring first to FIG. 1, wherein are best shown the general features of the invention, the fire fighting turret, indicated generally by the reference numeral 10, is shown in use on the roof of a cab of a fire truck 11. A body 14 of a first turret protrudes from the fire truck and is provided in its upper portion with a nozzle 13. A second supply pipe 15 leads through the roof and contains a second fire extinguishing medium, while a connection 18 joins the supply pipe 15 to a second barrel 12.

Figure 2:
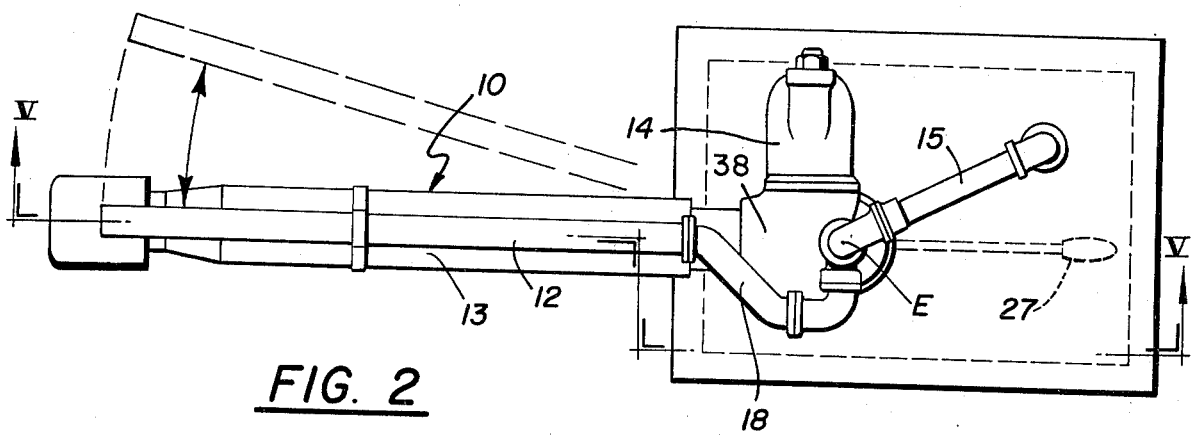
FIG. 2 is a plan view of the turret.
Figure 3:
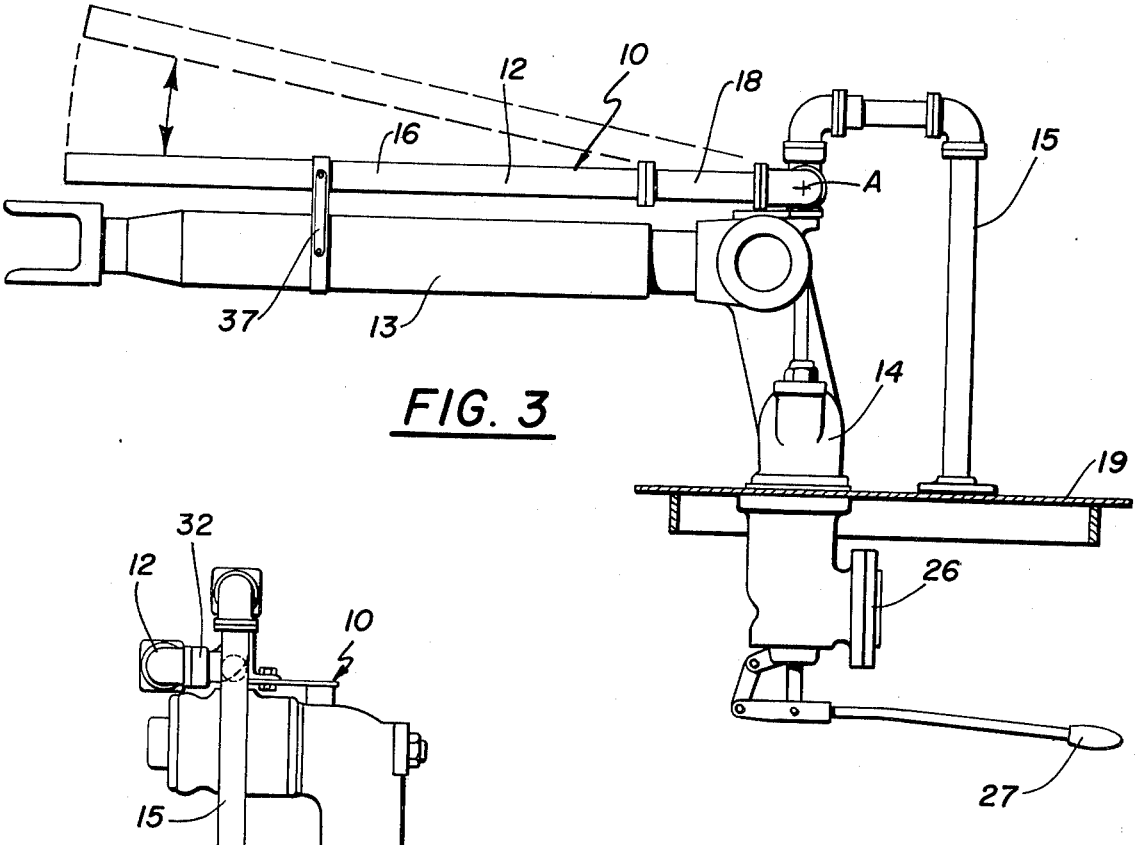
FIG. 3 is a front elevational view of the turret.
Figure 4:
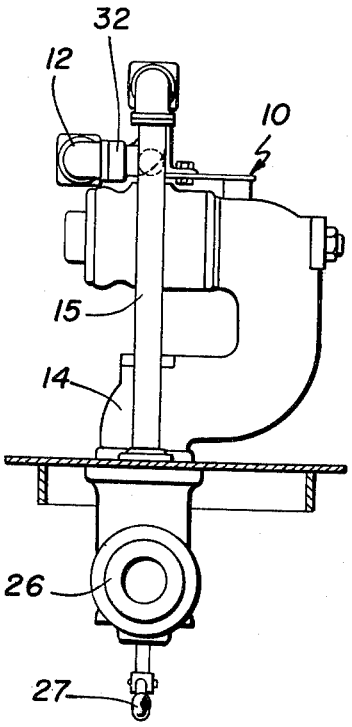
FIG. 4 is an end elevational view of the invention taken from the right side of FIG. 3.

In FIGS. 2, 3, and 4 it can be seen that the body 14 extends from the roof 19 of the cab and is provided with a flanged base 26 which is adapted to be connected to a source of primary extinguishing medium to pass to the nozzle 13 through the head 38. A handle 27 is located at the bottom of the base 26 inside of the cab of the fire truck and can be used for directing the nozzles both in the horizontal and the vertical plane.

Figure 5:
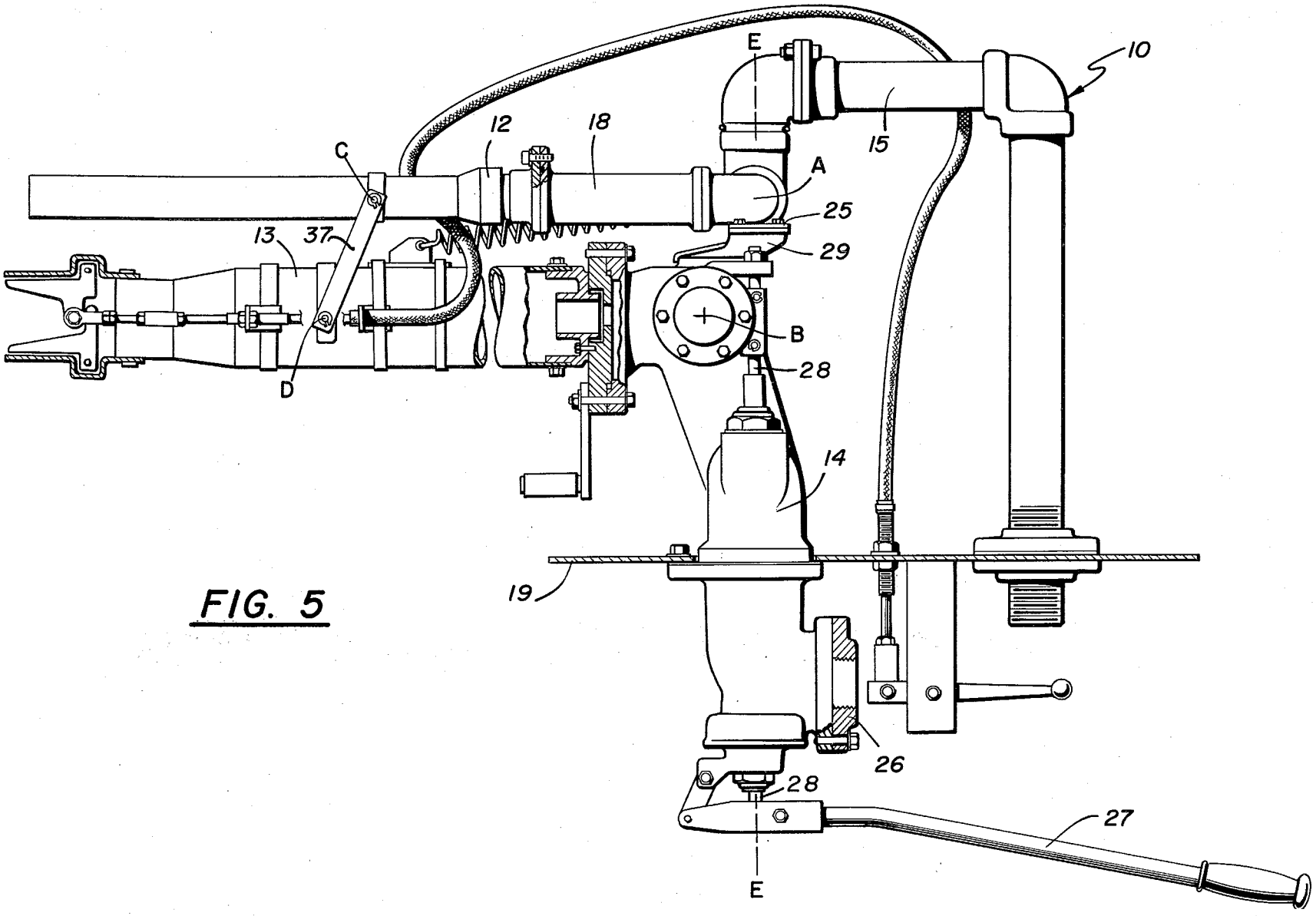
FIG. 5 is a vertical sectional view of the turret taken on the line V—V of FIG. 2.

FIG. 5 shows further details of the construction. The nozzle 13 is pivoted on the body 14 for rotation about the horizontal axis B and this motion takes place by operating the handle 27 through a vertical slidable rod 28. Passages are provided through the body 14 and head 38 leading from the flanged base 26 to the interior of the nozzle 13 for providing a primary fire extinguishing medium. A table 29 is mounted on the body 14 for mounting flange 25 thus carrying components 31, 32, 33, 34 and nozzle 12. Since the pipe 15 is fixed, while the barrel 12 must be moved, the connection 18 provides for movement of the barrel 12 about the horizontal axis A. This movement takes place when the handle 27 is operated, so that both barrels move together. While the barrels 12 and 13 rotate about different horizontal axes A and B, respectively, they rotate in a horizontal plane about the same axis E—E which is the axis enjoyed by the shaft 28.

Figure 6:
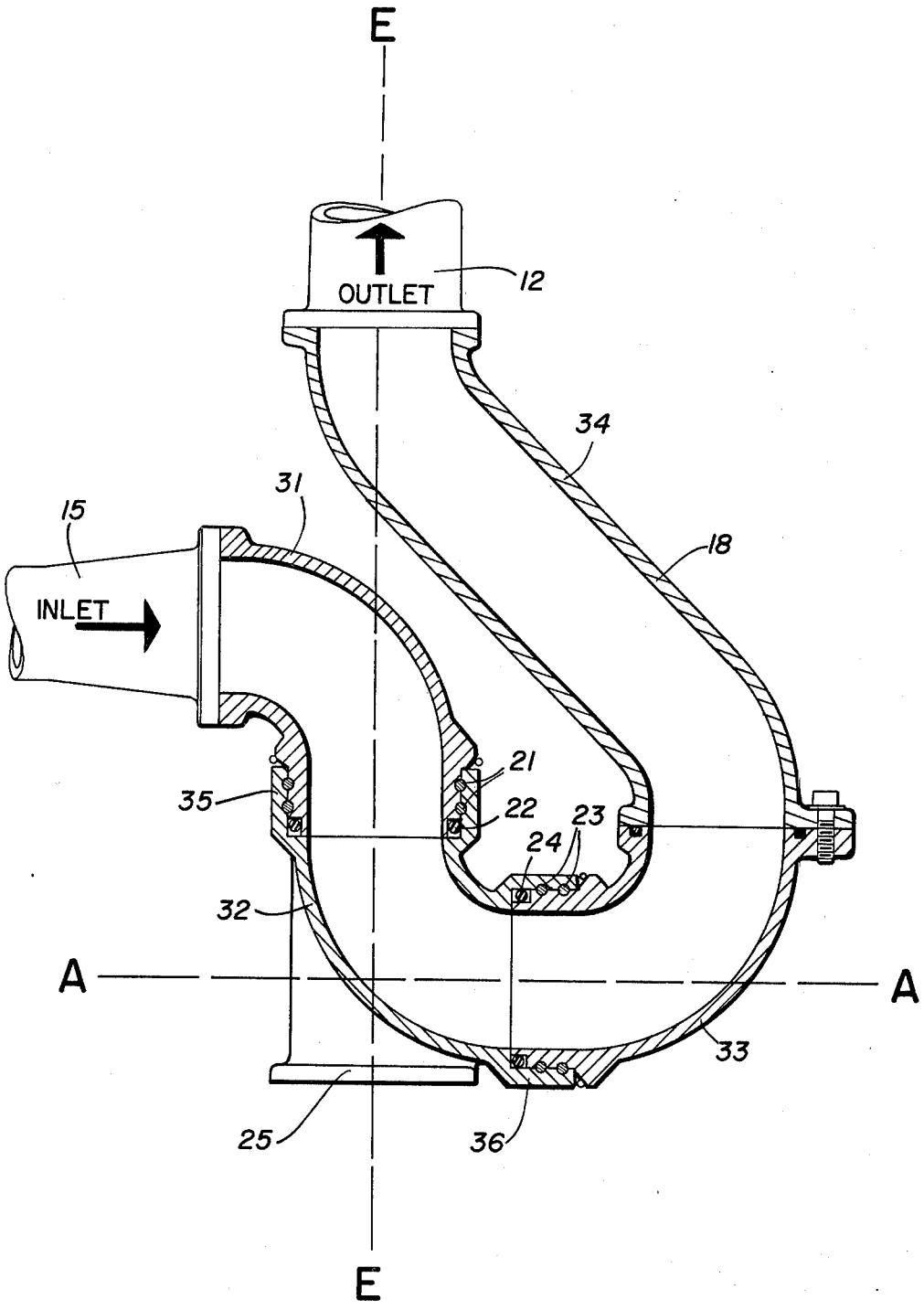
FIG. 6 is a vertical sectional view of a portion of the apparatus with parts rotated into the plane of the drawing for ease of understanding.

FIG. 6 shows the manner in which the connection 18 is formed. First of all, of course, it connects the fixed inlet pipe 15 to the swingable barrel 12. A first 90° elbow 31 is connected to a second 90° elbow 32, which has the base flange 25 (which in turn is connected to another third 90° elbow 33) which in turn is connected to a fitting 34. The first 90° elbow 31 has one leg fixedly attached to the pipe 15. The second elbow 32 has one leg attached by a first swivel joint 35 to the other leg of the first elbow 31. The third elbow 33 has one leg attached by a second swivel joint 36 to the other leg of the second elbow 32. Finally, the fitting 34 has one end fixedly attached to the other leg of the third elbow 33 and has its other end fixedly attached to the other end of the barrel 12. The center line of the barrel 12 lies in a plane passing through the axis of rotation E—E of the first swivel joint 35.

The axis of rotation A—A of the second swivel joint is at a right angle to the axis rotation E—E of the first swivel joint 35. The axis of rotation A—A of the second swivel joint 36 is horizontal to allow the barrel 12 to swing in a vertical plane. The axis of rotation E—E of the first swivel joint is vertical to allow the barrel to be rotated about the vertical axis. The vertical plane of swing of the barrel 12 passes through the vertical axis of rotation E—E, so that the nozzle reaction force produces a zero force couple about the said vertical axis.

Each of the swivel joints 35 and 36 consists of a bell with a counterbore surface formed on one of the elbows and a tube with a cylindrical outer surface formed on the other of the elbows, the cylindrical outer surface fitting closely in the counterbore surface. Both of these meeting surfaces are provided with a pair of axially-spaced grooves, each groove of one surface facing a corresponding groove in the other surface and a set of balls 21 resides in the grooves of the swivel joint 35, while a set of balls 23 reside in the swivel joint 36. The swivel joint, therefore, is capable of allowing the swivelling action while resisting axial and radial forces that are impressed on the joint. The cylindrical surface of each of the swivel joints is provided with a groove in which resides an O-ring 22 in the case of the swivel joint 35 and an O-ring 24 in the case of the swivel joint 36. The O-ring in each case extends out of its groove into engagement with the corresponding counterbore surface.

As has been stated above, the second 90° elbow 32 is provided with an integral base 25 by which it is fastened to the table 29, fixedly mounted at the top of the main body 14. This allows pivotal movement selectively about a vertical axis E—E and about a horizontal axis A—A. The actuating handle 27 in the fire truck cab is capable of bringing about the movement in either of the axes. A link 37 is pivoted to each of the barrels 12 and 13 and joins them, so that the two barrels joined by the link 37 and by the table 29 act as a parallelagram linkage with the barrels staying parallel to and spaced from one another, as they are swiveled in vertical and horizontal planes.

The operation of the present apparatus and its advantages will now be evident from the above description. The operation of the handle 27 within the fire truck cab causes both the barrel 13 and the barrel 12 to rotate about the vertical axis E—E and also to swing in the same vertical plane. The barrel 12 pivoting about the axis A, while the barrel 13 pivots about the axis B. In either case the barrels stay in parallel relationship and furthermore, the center line of each barrel passes through the axis of rotation E—E, so that any reaction from the nozzles 16 and 17 does not appear as a twisting or turning couple at that pivot. In other words, there is a zero force couple on the axis due to nozzle reaction force. This makes the apparatus much easier to handle by the operator and also does not put any strain on the elements of the apparatus. A method of introducing the secondary fire extinguishing medium into the upper barrel 12 from the fixed pipe 15 is accomplished by the use of only three components. The fittings are capable of resisting considerable pressure, as well as being free of any deterioration (as would be true in the case of a flexible conduit) due to the heat of the fire, or a corrosive atmosphere. Furthermore, the elements of fire fighting equipment are often accidently struck by other tools and must be able to resist damage due to such striking. This advantageous connection has been accomplished by the present invention by the use of only two swivel joints mounted in the proper location.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Fire fighting turret, comprising a. a fixed inlet pipe, b. a barrel having an outlet nozzle at one end, c. a first 90° elbow having one leg fixedly attached to the pipe, d. a second 90° elbow having one leg attached by a first swivel joint to the other leg of the first elbow, the second 90° elbow being provided with an integral base which is fastened to a table which is mounted on a main base for pivotal movement selectively about a vertical axis and about a horizontal axis, e. a third 90° elbow having one leg attached by a second swivel joint to the other leg of the second elbow, and f. a fitting having one end fixedly attached to the other leg of the third elbow and having the other end fixedly attached to the other end of the barrel, the centerline of the barrel lies in a plane passing through the axis of rotation of the first swivel joint.

2. Fire fighting turret as recited in claim 1, wherein the main base is adapted to be mounted on the roof of a cab of a fire truck, and wherein an actuating handle is provided within the cab for bringing about the movement about either of the axes.

3. Fire fighting turret as recited in claim 2, wherein the table is provided with a second barrel that is movable with it, and wherein a secondary medium passage is formed in the main base leading to the second barrel.

4. Fire fighting turret as recited in claim 1, wherein the axis of rotation of the second swivel joint is at a right angle to the axis of rotation of the first swivel joint.

5. Fire fighting turret as rrecited in claim 4, wherein the axis of rotation of the second swivel joint is horizontal to allow the barrel to swing in a vertical plane and the axis of rotation of the first swivel joint is vertical to allow the barrel to be rotated about that vertical axis, the vertical plane of swing of the barrel passing through the vertical axis of rotation, so that the nozzle reaction force produces a zero force couple about the said vertical axis.

6. Fire fighting turret as recited in claim 1, wherein each swivel joint consists of a bell with a counterbore surface and a tube with a cylindrical outer surface that fits closely in the counterbore surface, both surfaces being provided with a pair of axially-spaced grooves, each groove of one surface facing a corresponding groove in the other surface, and a set of balls residing in the grooves to allow swivelling action while resisting axial and radial forces impressed on the joint.

7. Fire fighting turret as recited in claim 6, wherein the cylindrical surface is provided with a groove in which resides an O-ring seal that extends out of the groove into engagement with the counterbore surface.

8. Fire fighting turret for use on the roof of the cab of a fire truck, comprising a. a fixed inlet pipe,
b. a barrel having an outlet nozzle at one end,
c. a first 90° elbow having one leg fixedly attached to the pipe,
d. a second 90° elbow having one leg attached by a first swivel joint to the other leg of the first elbow,
e. a third 90° elbow having one leg attached by a second swivel joint to the other leg of the second elbow, and
f. a fitting having one end fixedly attached to the other leg of the third elbow and having the other end fixedly attached to the other end of the barrel, the centerline of the barrel lying in a plane passing through the axis of rotation of the first swivel joint,
g. an integral base provided on the second 90° elbow,
h. a table to which the integral base is fastened,
i. a main base mounted on the roof and on which the table is mounted for pivotal movement selectively about a vertical axis, and
j. an actuating handle within the cab for bringing about the movement about either of the axes.

* * * * *